US006051414A

United States Patent [19]

Videbæk et al.

[11] Patent Number: 6,051,414

[45] Date of Patent: Apr. 18, 2000

[54] PROCESS FOR DEFUZZING AND DEPILLING CELLULOSIC FABRICS

[75] Inventors: Thomas Videbæk, Hellerup; Lars Dalgård Andersen, Virum, both of Denmark

[73] Assignee: Novo Nordisk A/S, Bagsvaerd, Germany

[21] Appl. No.: 08/415,108

[22] Filed: Mar. 29, 1995

Related U.S. Application Data

[63] Continuation of application No. 08/285,599, Aug. 3, 1994, abandoned, which is a continuation of application No. 07/863,993, Apr. 6, 1992, abandoned.

[51] Int. Cl.[7] ..... C12N 9/00

[52] U.S. Cl. ..... 435/209; 435/263; 435/265; 26/1; 252/8.81

[58] Field of Search ..... 435/209, 263, 435/265; 252/8.81; 26/1

[56] References Cited

U.S. PATENT DOCUMENTS

| | | | |
|---|---|---|---|
| 1,421,613 | 7/1922 | Takamine et al. | 435/263 |
| 4,479,881 | 10/1984 | Tai | 252/8.81 |
| 4,489,455 | 12/1984 | Spendel | 8/158 |
| 4,648,979 | 3/1987 | Parslow et al. | 252/8.81 |
| 4,661,289 | 4/1987 | Parslow et al. | 252/547 |
| 4,912,056 | 3/1990 | Olson | 435/263 |
| 5,019,292 | 5/1991 | Baeck et al. | 252/174.25 |

FOREIGN PATENT DOCUMENTS

| | | | |
|---|---|---|---|
| 0 307 564 | 3/1989 | European Pat. Off. . | |
| 0455804 | 10/1936 | United Kingdom | 435/263 |
| WO 93/13261 | 7/1993 | WIPO . | |

OTHER PUBLICATIONS

Abstract of Cotton Grower, vol. 27, No. 7, pp. 20–21 (1991).

*Primary Examiner*—Leon B. Lankford, Jr.
*Attorney, Agent, or Firm*—Steve T. Zelson, Esq.; Elias J. Lambiris, Esq.

[57] ABSTRACT

This invention is in the field of Bio-Polishing. More specifically, the invention relates to a process for achieving Bio-Polishing effects during the manufacture of cellulosic fabrics.

11 Claims, No Drawings

PROCESS FOR DEFUZZING AND DEPILLING CELLULOSIC FABRICS

This application is a continuation of application Ser. No. 08/285,599, filed Aug. 3, 1994 now abandoned, which is a continuation application of application Ser. No. 07/863,993, filed Apr. 6, 1992 now abandoned, the contents of which are incorporated herein by reference.

TECHNICAL FIELD

This invention relates to a process for defuzzing and depilling cellulosic fabrics.

BACKGROUND ART

Without the application of finishing components, most cotton fabrics and cotton blend fabrics have a handle appearance that is rather hard and stiff. The fabric surface also is not smooth because small fuzzy microfibrils protrude from it. In addition, after a relatively short period of wear, pilling appears on the fabric surface thereby giving it an unappealing, worn look.

A high degree of fabric softness and smoothness can be obtained by using fine (low-denier) yarns in weaving. However, the resulting cost is high as the loom output decreases concurrently with the (weft) yarn diameter.

A less expensive way of ensuring a soft and smooth fabric "handle" is to impregnate the finished fabric with a softening agent, typically a cationic, sometimes silicone-based, surface active compound. This treatment also has some functional disadvantages. It does not remove pills and fuzz. The fabric obtains a somewhat greasy "handle" and its moisture absorbency is often considerably reduced, which is a great disadvantage, especially with towels and underwear. Moreover, the fabric is not wash-proof.

Another method for obtaining a soft and smooth fabric is subjecting cellulosic fabrics to treatment by cellulytic enzymes during their manufacture. This treatment is known as Bio-Polishing.

Bio-Polishing is a specific treatment of the yarn surface which improves fabric quality with respect to handle and appearance without loss of fabric wettability. The most important effects of Bio-Polishing can be characterized by less fuzz and pilling, increased gloss/luster, improved fabric handle, increased durable softness and improved water absorbency.

Bio-Polishing usually takes place in the wet processing of the manufacture of knitted and woven fabrics. Wet processing comprises such steps as e.g. desizing, scouring, bleaching, washing, dyeing/printing and finishing. During each of these steps, the fabric is more or less subjected to mechanical action.

In general, after the textiles have been knitted or woven, the fabric proceeds to a desizing stage, followed by a scouring stage, etc. Desizing is the act of removing size from textiles. Prior to weaving on mechanical looms, warp yarns are often coated with size starch or starch derivatives in order to increase their tensile strength. After weaving, the size coating must be removed before further processing the fabric in order to ensure a homogeneous and wash-proof result. The preferred method of desizing is enzymatic hydrolysis of the size by the action of amylases.

It is known that in order to achieve the effects of Bio-Polishing, a combination of enzymatic action and mechanical action is required. It is also known that if the enzymatic treatment is combined with a conventional treatment with softening agents, "super-softness" is achievable.

It was hitherto believed that enzymatic and mechanical action had to take place simultaneously and that the effect of enzymatic action ceased once the enzyme became inactivated. Consequently, the enzymatic action and the mechanical action hitherto have been carried out in a single separate step of the manufacturing process as a batch process, e.g. in a high-speed circular system such as "jet/overflow" dyeing machines and high-speed winches, where a combination of enzymatic and mechanical action can be obtained. Bio-Polishing, therefore, could be incorporated into existing continuous fabric manufacturing process only with great difficulty.

It is the object of the present invention to provide a process for achieving Bio-Polishing effects which (1) can be implemented in existing processes and in existing apparatus, (2) can be adapted to continuous processes and (3) is time saving.

SUMMARY OF THE INVENTION

The present invention is directed to a process for achieving Bio-Polishing effects during the manufacture of cellulosic fabrics comprising the successive steps of (1) cellulase treatment of a fabric, essentially without mechanical treatment, and (2) mechanical treatment of the fabric.

DETAILED DISCLOSURE OF THE INVENTION

The present invention provides a process for achieving Bio-Polishing effects during the manufacture of cellulosic fabrics. The process of the invention finds application in treatment of cellulosic yarns or materials. The materials may be woven or knitted, and may be made of cellulosic fibers, e.g. cotton, cotton/polyester blends, viscose (rayon), viscose/polyester blends, flax (linen) and ramie or other fabrics containing cellulose fibers.

It has surprisingly been found that Bio-Polishing effects can be obtained if enzymatic action and mechanical action are performed separately or if enzymatic action is terminated before mechanical action is exerted. It is, therefore, now possible to achieve the desired Bio-Polishing effects even though enzymatic action and mechanical action take place in different steps.

The process of the present invention has many advantages. It is time saving. It can be implemented in existing processes and existing apparatus, and can be adapted to continuous processes as well.

The process of the invention comprises the successive steps of cellulase treatment of the fabric and mechanical treatment of the fabric. The cellulase treatment is performed essentially without mechanical treatment, but may be also performed without any mechanical treatment at all.

The process of bringing an enzyme solution into contact with the fabric in itself requires a certain degree of mechanical action. Moreover, if the enzymatic treatment is performed simultaneously with e.g. desizing, a certain mechanical action is exerted during this step. Characteristic of these processes, however, is that the mechanical action exerted during the cellulase treatment is inadequate to achieve the desired Bio-Polishing effects, and that subsequent mechanical treatment is required.

The separate steps of the process of the invention may be carried out in combination with or incorporated into other procedures belonging to the wet processing of the manufacture of fabrics (e.g. desizing, scouring, bleaching, dying/printing, washing and finishing) or they may be interposed between or separated by other such procedures.

Any enzymatic treatment requires a certain hold-time in order to obtain an optimum effect. A major feature of the present invention is that the cellulytic enzymes do not necessarily have to be active during mechanical treatment of the fabric. It has surprisingly been found that the desired effects can be obtained only if a certain hold-time is maintained during the cellulase treatment. Whether the cellulytic enzymes become inactivated immediately after the enzymatic treatment of the fabric or later during mechanical treatment of the fabric really does not matter, as long as a hold-time of a certain extent is maintained.

Accordingly, in one embodiment of the process of the invention, mechanical treatment of the fabric is accomplished subsequent to inactivation of the cellulytic enzymes, e.g. during one or more of the remaining fabric manufacturing processes or as an additional step. In another embodiment of the process of the invention, inactivation of the cellulytic enzymes occurs during mechanical treatment of the fabric. In a further embodiment of the process of the invention, inactivation of the cellulytic enzymes occurs after mechanical treatment of the fabric.

Inactivation of the cellulytic enzymes can take place in various ways. For example, inactivation occurs if the temperature or pH is elevated to a certain level for a certain period, depending on the thermostability or the pH tolerance of the enzyme employed. Certain aggressive agents, e.g. bleaching agents, may also inactivate enzymes.

The enzymatic treatment can be carried out in continuous processes and in existing apparatus, where the required hold-time can be maintained, e.g. in a J-Box, on a Pad-Roll, in a Pad-Bath, etc. This is another major feature of the present invention.

Cellulase treatment

The process of the invention comprises cellulase treatment of the fabric.

Cellulytic enzymes are well known. Preferred cellulytic enzymes are cellulases derived from fungi belonging to the genera Humicola, e.g. *H. lanuginosa, H. insolens* or *H. grisea* var. *thermoidea;* Actinomyces; Trichoderma, e.g. *T. viride* or *T. longibrachiatum;* Myrothecium, e.g. *M. verrucaria;* Aspergillus, e.g. *A. niger* or *A. oryzae;* Botrytis, e.g. *B. cinerea;* or cellulases derived from bacteria belonging to the genera Bacillus; Cellulomonas; Aeromonas; Streptomyces; or Hymenomycetes.

A commercially available cellulase product is e.g. Cellusoft™, supplied by Novo Nordisk A/S, Denmark.

As mentioned above, cellulase treatment of the fabric may be carried out simultaneously with other fabric manufacturing procedures, e.g. desizing.

Cellulase treatment according to the present invention and desizing are reconcilable processes that can be conducted at the same conditions, i.e. pH, temperature, dosage/time ratio, etc. By performing these processes simultaneously, the overall fabric manufacturing process becomes shortened. Such time saving arrangements are a major benefit of the process of the invention.

Enzyme dosage greatly depends on the enzyme reaction time, i.e. a relatively short enzymatic reaction time necessitates a relatively increased enzyme dosage, and vice versa. In general, enzyme dosage may be stipulated in accordance with the reaction time available. In this way cellulase treatment of the fabric according to the present invention can be brought into conformity with e.g. the desizing conditions, if for instance these two reactions are to be carried out simultaneously.

An enzyme dosage/time ratio similar to what is known from conventional Bio-Polishing may be used. Preferred enzyme dosages are from 100 to 100,000 NCU/kg fabric, and preferred reaction times are from 1 minute to 24 hours.

In the context of this invention, cellulase activity can be expressed in Novo Cellulase Units (NCU). One NCU is defined as the amount of enzyme which forms an amount of reducing carbohydrates equivalent to 1 $\mu$mol glucose per minute under standard conditions (i.e. pH 4.80; Buffer 0.1 M acetate; Substrate 10 g/l Hercules CMC type 7 LFD; Incub. temp. 40.0° C.; Incub. time 20 min; Enz. conc. approx. 0.041 NCU/ml). A folder, AF 187.2, describing this analytical method is available upon request from Novo Nordisk A/S, Denmark, which is incorporated herein by reference.

The performance of cellulytic enzymes greatly depends on process conditions such as e.g. pH and temperature. In accomplishing the process of this invention, of course, factors such as e.g. pH-dependent performance and thermal stability should be taken into consideration in the choice of cellulytic enzymes.

Other conditions such as e.g. the addition of wetting agents, etc., also depend on the overall process to be performed, as well as the enzyme employed.

Mechanical treatment

The process of the invention also comprises mechanical treatment of the fabric. If mechanical treatment is not accomplished no Bio-Polishing effects occur.

In the process of the invention essentially no mechanical treatment takes place during cellulase treatment of the fabric, i.e. the mechanical action that takes place during cellulase treatment is inadequate or negligible in relation to the mechanical action necessary for obtaining the desired (i.e. optimal) Bio-Polishing effects.

In the context of this invention any mechanical action that takes place subsequent to cellulase treatment of the fabric and throughout the remaining part of the fabric manufacturing process is to be considered a mechanical treatment of the fabric. Mechanical treatment may occur during wet processing, e.g. during scouring, bleaching, washing, dyeing/printing and finishing.

Looked upon isolated, none of the above steps may bring about sufficient mechanical action to obtain the desired Bio-Polishing effects. However, subsequent to the cellulase treatment step, every step in the remaining part of the fabric manufacturing process contributes to the overall mechanical treatment of the fabric. Moreover, an additional step involving mechanical treatment may be introduced into the process of the invention to ensure sufficient mechanical treatment.

Mechanical action may be caused by tumbling, by passing the fabric over rollers or cylinders, by pulling, tugging or stretching the fabric or by blasting or sparging the fabric.

Mechanical treatment according to this invention should be sufficient to obtain the desired Bio-Polishing effects. The process of the present invention may be controlled by monitoring the weight loss of the fabric during mechanical treatment. A weight loss of 0.5–10%, preferably 1–8%, more preferably 2–7% and most preferably 3–5%, will usually give proper softness and still keep the loss of strength at an acceptable level.

At a minimum, mechanical treatment sufficient to achieve Bio-Polishing effects is the mechanical action on fabrics during wash, i.e. tumbling, for 10 minutes in a washing machine (Washer Extractor, 50 l, 25 rpm), or any mechanical action equivalent thereto.

The invention is further illustrated in the following examples which should not be construed to limit the scope of the present invention.

EXAMPLE 1

Softening Example

Towels (100% cotton) were immersed for approximately 1 min. in a bath with or without Cellusoft™ (Cellulase containing Bio-Polishing agent, having a cellulytic activity of 1,500 NCU/g, supplied by Novo Nordisk A/S, Denmark). A pH of 5.2 was measured.

The towels were then placed in a plastic bag and left at ambient or elevated temperatures for various lengths of time, cf. Table 1. The enzyme reaction was stopped by rinse in cold, diluted NaOH, pH 10.

Subsequently, the towels were washed (i.e. mechanical treatment by tumbling) in a washing machine (model Washer Extractor, 50 L, 25 rpm) for 15 min. at 55° C. The liquid/fabric ratio was 10:1.

Ultimately the fabric was line dried.

The results of this trial are presented in Table 1 below.

TABLE 1

| Enzyme Dosage (NCU/l) | Reduction of Lint-Balls [1] | Stiffness [2] (kg) | Softness [3] | Enzyme Reaction Time |
|---|---|---|---|---|
| 1,500 | 2 | 1.13 | 1 | 4 hrs/rm. temp. |
| 1,500 | 3 | 1.09 | 1 | 18 hrs/rm. temp. |
| 1,500 | 4 | 0.93 | 2 | 1 hr/60° C. |
| 15,000 | 3 | 1.00 | 1 | 4 hrs/rm. temp. |

4 better than 3 > 2 > 1
[1] Visual evaluation
[2] Fabric stiffness test (on a King ™ stiffness tester)
[3] Panel ranking Table 1 shows that satisfactory softening effect and reduction of lint-balls were obtained by the process of the invention.

EXAMPLE 2

Desizing and Softening Example

Towels (100% cotton in loop yarn, and 90% cotton and 10% polyester in warp and weft yarn) were treated at a liquid/fabric ratio of 10:1 and pH 5.2, at the following conditions:

| | |
|---|---|
| A: | 3 g/l Berol 08 ™[1]; 1 g/l Thermozyme 120 ™[2]; and No cellulase. |
| B: | 3 g/l Berol 08 ™; 1 g/l Thermozyme 120 ™; and 1 g/l Cellusoft ™[3]. |
| C: | 3 g/l Berol 08 ™; 1 g/l Thermozyme 120 ™; and 10 g/l Cellusoft ™. |

[1]Fatty alcohol ethoxylate, a surfactant supplied by Berol AB, Sweden.
[2]Desizing agent containing α-amylase, having a amylolytic activity of 120 units/g, supplied by Novo Nordisk A/S, Denmark.
[3]Cellulase containing Bio-Polishing agent, having a cellulytic activity of 1,500 NCU/g, supplied by Novo Nordisk A/S, Denmark.

The towels were soaked for 1 hour at 60° C. Afterwards the towels were centrifugated for 5 minutes in a household machine, and the enzyme was inactivated with 20 mM NaOH, pH 10.

Subsequently, the towels were washed (i.e. mechanical treatment) in a washing machine (model Washer Extractor, 50 L, 25 rpm) for 60 min. at 60° C., at a liquid/fabric ratio of 10:1.

Ultimately, the fabric was line dried.

The results of this trial are presented in Table 2 below.

TABLE 2

| | Enzyme Dosage (NCU/l) | Reduction of lint-balls [1] | Stiffness [2] (kg) | Softness [3] |
|---|---|---|---|---|
| A | 0 | 1 | 1.03 | 1 |
| B | 1,500 | 2 | 0.96 | 2 |
| C | 15,000 | 3 | 1.02 | 3 |

3 better than 2, better than 1
[1] Visual evaluation
[2] Fabric stiffness test (on a King ™ stiffness tester)
[3] Panel ranking Table 2 shows that satisfactory softening effect and reduction of lint-balls were obtained by the process of the invention.

EXAMPLE 3

Softening Example

Towels (similar to the towels used in Example 2) were washed 2 times with 2 g/l All™ detergent.

Afterwards the fabric was treated at a liquid/fabric ratio of 10:1 and pH 5.2, at the following conditions:

| | |
|---|---|
| A: | 3 g/l Berol 08 ™; and No Cellusoft. |
| B: | 3 g/l Berol 08 ™; and 1 g/l Cellusoft ™. |

The towels were soaked for 1 hour at 60° C. Afterwards the towels were centrifugated for 5 minutes in a household machine, and the enzyme was inactivated with 20 mM NaOH, pH 10.

Subsequently, the towels were washed (i.e. mechanical treatment) in a washing machine (model Washer Extractor, 50 L, 25 rpm) for 60 min. at 55° C., at a liquid/fabric ratio of 10:1.

Ultimately, the fabric was line dried.

The results of this trial are presented in Table 3 below.

TABLE 3

| | Enzyme Dosage (NCU/l) | Reduction of Lint-Balls[1] | Stiffness[2] (kg) | Softness[3] |
|---|---|---|---|---|
| A | 0 | 1 | 1.46 | 1 |
| B | 1,500 | 2 | 1.37 | 2 |

[1]Visual evaluation
[2]Fabric stiffness test (on a King ™ stiffness tester)
[3]Panel ranking Table 3 shows that the process of the invention achieves satisfactory softening effect and reduction of lint-balls.

We claim:

1. A process for manufacturing a cellulosic fabric, comprising (a) a treatment of an initial cellulosic fabric with a cellulytic enzyme, essentially without any mechanical treatment to yield a first stage fabric; and (b) a mechanical treatment of the first stage fabric after the cellulase treatment to yield a second stage fabric; where the process is continuous; where the mechanical treatment is selected from the group consisting of tumbling the first stage fabric, passing the first stage fabric over rollers, passing the first stage fabric over cylinders, pulling the first stage fabric, tugging the first stage fabric, stretching the first stage fabric, blasting the first stage fabric, sparging the first stage fabric, or any combination of any of the foregoing; and where the second stage fabric has less fuzz, less pilling, more gloss/luster, increased fabric handle, increased desirable softness, and the same or greater fabric wettability than the initial fabric.

2. The process according to claim 1, wherein the cellulase treatment is performed without any mechanical treatment.

3. The process according to claim 1, wherein the mechanical treatment of fabric is performed (a) after the cellulytic enzyme are inactivated, (b) during one or more of the fabric manufacturing processes after the cellulase treatment or (c) as an additional step.

4. The process according to claim 1, wherein the cellulytic enzyme are inactivated during the mechanical treatment of the fabric.

5. The process according to claim 1, wherein the cellulytic enzyme are inactivated after the mechanical treatment of the fabric.

6. The process according to claim 1, wherein the cellulase treatment of the fabric and desizing are carried out simultaneously.

7. The process according to claim 1, wherein the cellulase treatment of the fabric and scouring are carried out simultaneously.

8. The process according to claim 1, wherein the cellulase treatment of fabric is accomplished in a J-Box, on a pad-Roll or in a Pad-Bath.

9. The process according to claim 1, wherein the cellulosic fabric is a towel.

10. In a process for manufacturing a cellulosic fabric comprising desizing, scouring, bleaching and washing, wherein the improvement is that the process is a continuous process and further comprises (a) a cellulase treatment of an initial cellulosic fabric, essentially without any mechanical treatment to yield a first stage fabric; and (b) a mechanical treatment of the first stage fabric after the cellulase treatment to yield a second stage fabric; where the process is continuous; where the mechanical treatment is selected from the group consisting of tumbling the first stage fabric, passing the first stage fabric over rollers, passing the first stage fabric over cylinders, pulling the first stage fabric, tugging the first stage fabric, stretching the first stage fabric, blasting the first stage fabric, sparging the first stage fabric, or any combination of any of the foregoing; and where the second stage fabric has less fuzz, less pilling, more gloss/luster, increased fabric handle, increased desirable softness and the same or greater fabric wettability than the initial fabric.

11. A process for manufacturing a cellulosic fabric comprising:

(a) a treatment of an initial cellulosic fabric with a cellulytic enzyme, essentially without any mechanical treatment to yield a first stage fabric; and (b) a mechanical treatment of the first stage fabric after the cellulase treatment to yield a second stage fabric; where the process is continuous; where the mechanical treatment is selected from the group consisting of tumbling the first stage fabric, passing the first stage fabric over rollers, passing the first stage fabric over cylinders, pulling the first stage fabric, tugging the first stage fabric, stretching the first stage fabric, blasting the first stage fabric, sparging the first stage fabric, or any combination of any of the foregoing; and where the second stage fabric has less fuzz, less pilling, more gloss/luster, increased fabric handle, increased desirable softness and the same or greater fabric wettability than the initial fabric.

* * * * *

UNITED STATES PATENT AND TRADEMARK OFFICE

CERTIFICATE OF CORRECTION

PATENT NO. : 6,051,414

DATED : April 18, 2000

INVENTOR(S) : Videbaek et al.

It is certified that error appears in the above-identified patent and that said Letters Patent is hereby corrected as shown below:

ON THE FRONT PAGE OF PATENT:

Delete "[73] Assignee: Novo Nordisk A/S, Bagsvaerd, Germany", and insert --[73] Assignee: Novo Nordisk A/S, Bagsvaerd, Denmark--

IN THE CLAIMS:

Column 7, line 35: Delete "pad-Roll", and insert --Pad-Roll--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*